United States Patent [19]

Eckhold et al.

[11] 4,181,002

[45] Jan. 1, 1980

[54] TOOLS FOR BENDING SHEET METAL

[75] Inventors: Gerd-Jürgen Echold, St. Andreasberg; Hans Maass, Bad Lauterberg, both of Fed. Rep. of Germany

[73] Assignee: Walter Eckold Vorrichtungs u. Gerätebau Sperrluttertal, St. Andreasberg, Fed. Rep. of Germany

[21] Appl. No.: 825,916

[22] Filed: Aug. 19, 1977

[30] Foreign Application Priority Data

Sep. 22, 1976 [DE] Fed. Rep. of Germany ..... 2642549

[51] Int. Cl.[2] ..... B21D 5/04

[52] U.S. Cl. ..... 72/387; 72/453.16

[58] Field of Search ..... 72/387, 388, 310, 319, 72/453.15, 453.16

[56] References Cited

U.S. PATENT DOCUMENTS

| | | | |
|---|---|---|---|
| 2,184,949 | 12/1939 | Schwartz | 72/402 |
| 2,963,066 | 12/1960 | Nelson | 72/319 |
| 3,212,316 | 10/1965 | Smith | 72/453.16 |
| 3,301,034 | 1/1967 | Boettcher | 72/321 |
| 3,400,568 | 9/1968 | Brandner | 72/387 |
| 4,002,049 | 1/1977 | Randolph | 72/388 |

FOREIGN PATENT DOCUMENTS

| | | | |
|---|---|---|---|
| 1035456 | 7/1958 | Fed. Rep. of Germany | 72/388 |

*Primary Examiner*—C. W. Lanham
*Assistant Examiner*—Gene P. Crosby
*Attorney, Agent, or Firm*—H. Dale Palmatier

[57] ABSTRACT

A sheet metal bending tool with first and second former members, one rotatable on a first axis, the former members being movable toward and away from each other on another axis normal to the first axis, the formers having opposed clamping faces, the rotatable former member having two clamping faces angularly related to each other by an angle equal to the angle of rotation during bending, the clamping face of the second former being toothed.

11 Claims, 10 Drawing Figures

TOOLS FOR BENDING SHEET METAL

This invention relates to tools for forming turned-over edges or flanges on sheet-metal workpieces such as panels or cut blanks.

A powered hand-tool is known for forming a right-angled edge on a sheet-metal workpiece. The known tool has a fixed backing jaw and a powered movable working jaw arranged parallel to the backing jaw. The working jaw is driven with a rotational movement about an axis parallel to the longitudinal axis of the jaws and has at one end a force-applying face opposed to a planar force-applying face of the backing jaw. The force-applying face of the working jaw has a recess defining a hook-shaped lug to act on an upstanding edge of a sheet metal workpiece so as to form a bent-over portion with the help of the planar force-applying face of the backing jaw. The working jaw has a shape such that a right-angled edge all along the edge of a workpiece can be formed in one continuous operation by moving the tool along the edge whilst the working jaw is continuously and repeatedly actuated.

It is an object of the invention to provide an improved tool for bending sheet metal.

The tool shown in the attached drawings consists of a housing, a substantially semi-cylindrical angle-faced bolt-shaped former-member which is arranged transversely of the longitudinal axis of a hydraulic piston and is rotatably mounted in a transverse recess in a mounting, the mounting being longitudinally displaceable in a forward part of the housing and acted upon at its rear by the hydraulic piston, the bolt-shaped former-member having upon its flat longitudinal face a longitudinal profile corresponding to a required edge profile, and an abutment plate, detachably connected to the housing and having an abutment edge extending parallel to the bolt-shaped former-member and of complementary profile, associated with the bolt-shaped former member.

Figure 1:
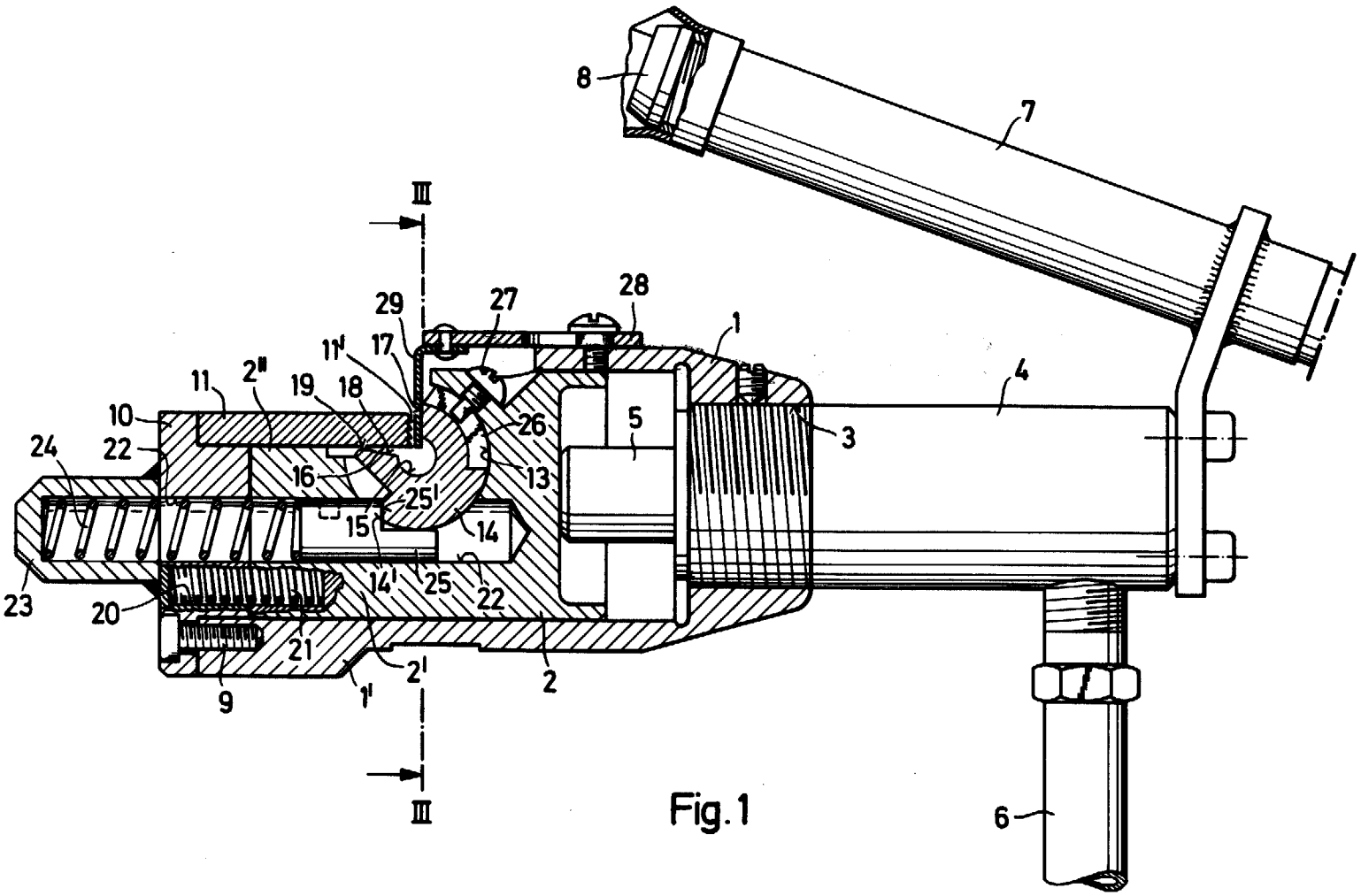
Figure 2:
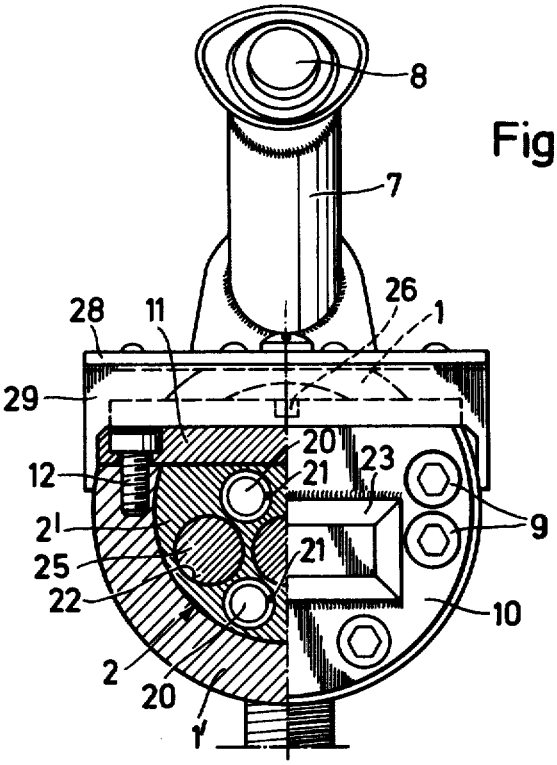
Figure 3:
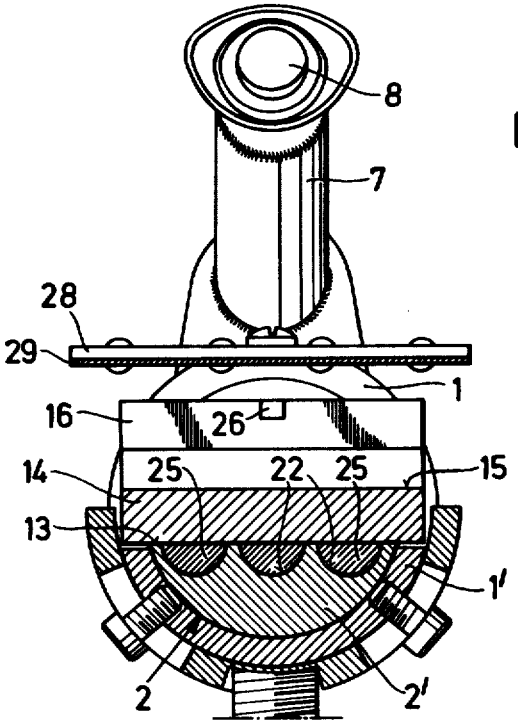
Figure 5:
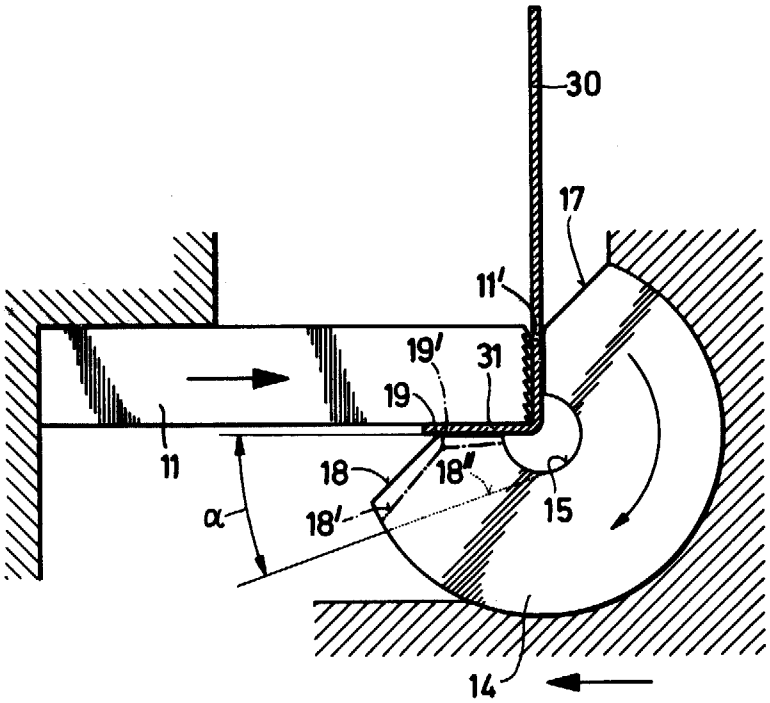
Figure 4:
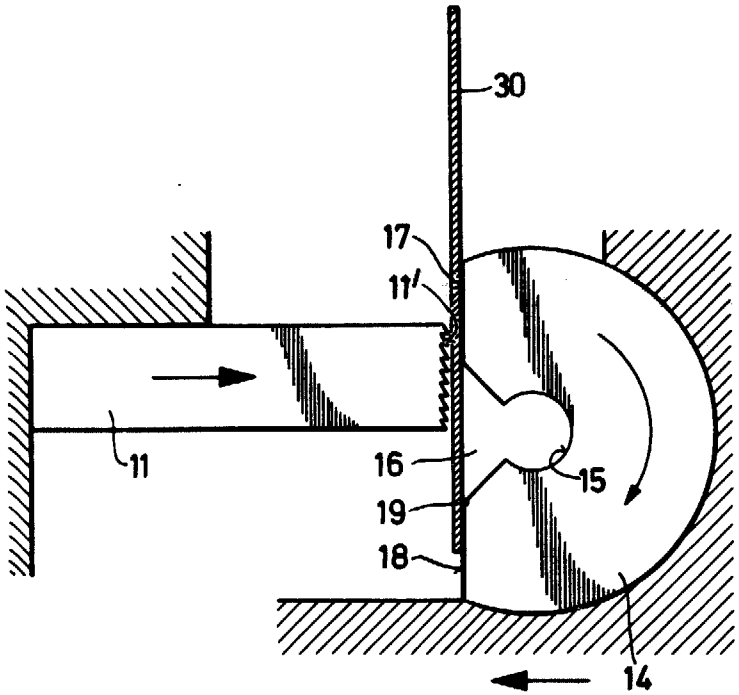
Figure 6:
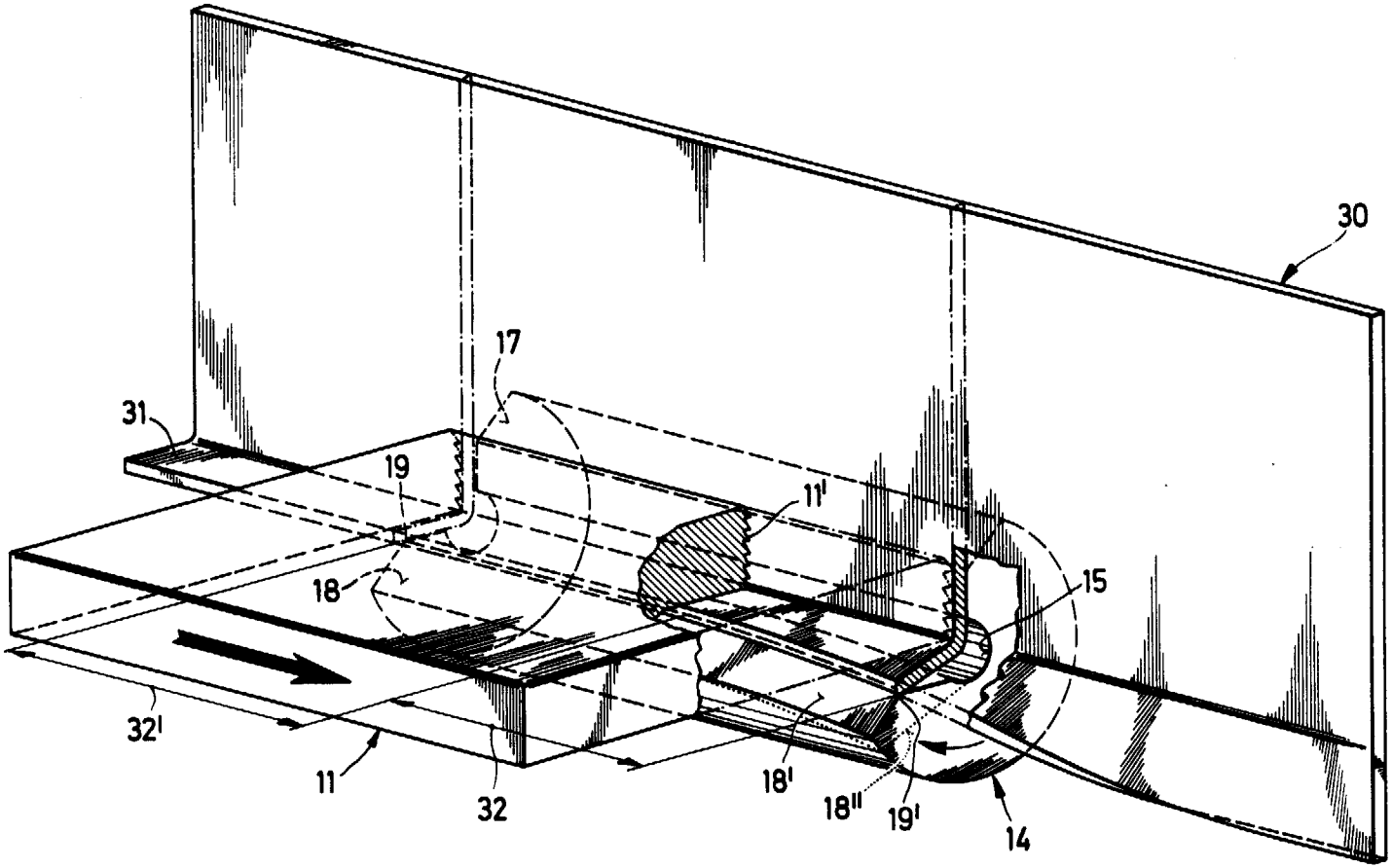
Figure 7:
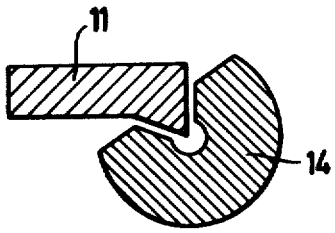
Figure 8:
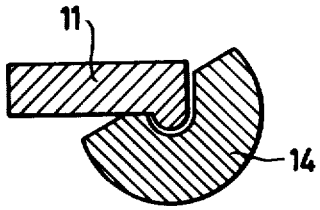
Figure 9:
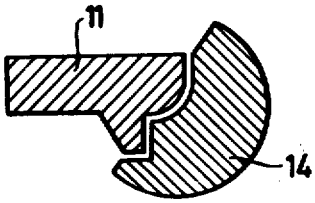
Figure 10:
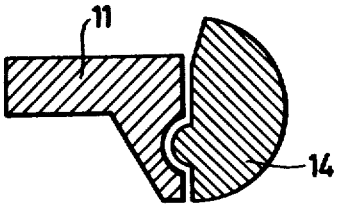

By way of example only, an illustrative embodiment of the invention will now be described with reference to the accompanying drawings in which:

FIG. 1 is a longitudinal section through a hand-tool embodying the invention, FIG. 2 is a front end view, partly in section, of the tool, FIG. 3 is a cross-section taken on the line III—III of FIG. 1, FIGS. 4 and 5 are diagrammatic illustrations of the mode of operation of the tool, FIG. 6 is a diagrammatic perspective view of two former-members of the tool in operation, and FIGS. 7 to 10 illustrative various alternative profiles for the former-members.

The drawings show a powered hand-tool for forming a turned-over edge or flange on a sheet metal workpiece such as a panel or cut blank. The tool comprises a housing into which is screwed a hydraulic piston-and-cylinder unit. The housing houses first and second former-members. The first former-member is an elongate body of generally semi-circular cross-section arranged transversely of the longitudinal axis of the hydraulic piston and rotably mounted in an elongate recess provided in a mounting member. The mounting member is longitudinally displaceable within the housing and is acted upon by the hydraulic piston. The first former-member has a profile corresponding to the desired edge profile to be formed on the sheet metal workpiece. The second former-member is a detachably-mounted plate having a working edge complementary to the profile formed on the first former-member.

The first former-member as shown in FIG. 1 has two working faces extending the entire length of the first former member with a sector-shaped space between them. The second former-member has a working face parallel to one of the working faces of the first former-member and the two former-members are arranged so that during the working stroke of the hydraulic piston, an edge of a sheet-metal workpiece inserted between the two former-members is clamped against the said one working face (acting as a clamping face) of the first former-member by the working face of the second former-member. Upon rotation of the first former member consequent upon continued force from the piston the edge of the workpiece is turned over by the other working face (acting as a bending face) of the first former-member.

The mounting member consists of a body portion with an elongate extension of generally semi-circular cross-section, the housing likewise consists of a body portion with an elongate extension of generally semi-circular cross-section, and the recess mounting the first former-member is of generally semi-circular cross-section and formed in the body portion of the mounting member.

For the purpose of automatically de-rotating the first former-member from the fully-actuated position to the de-actuated position, longitudinal bores are formed in the mounting member to accommodate return compression springs. These springs act against an end cap or some other abutment associated with the housing and apply force to respective thrust bolts displaceable in the longitudinal bores, the bolts co-operating with stops on the first former-member.

For the purpose of limiting the degree of de-rotation, grooves are provided in the first former-member, and respective limit stops or screws provided on the mounting member engage the grooves.

The second former-member is mounted so as to be exchangeable for another.

Referring now to the drawings in more detail, a mounting member 2 mounting a first former-member 14 is longitudinally displaceable at one end, the 'forward' end, of a housing 1 which is generally cylindrical and also serves as a grippable portion. The rear of the housing 1 has a tapped bore 3 into which is screwed a hydraulically actuated high-pressure piston-and-cylinder unit 4, the ram piston 5 of which applies a short-stroke actuating force to the mounting member 2. The high-pressure piston and cylinder unit 4 is connected by way of a high-pressure hose 6 to a hydraulic supply unit, not illustrated. A button 8 is arranged to trigger electrically a stroke of the piston or a continuous sequence of strokes is provided in a hand-grip 7.

For the purpose of guiding the mounting member 2 during its reciprocatory movements, the housing 1 has a substantially semi-cylindrical extension 1', having an end-cap 10 secured by means of fixing screws 9, and an exchangeable second former-member or abutment plate 11. Correspondingly, the mounting member 2 has a likewise substantially semi-cylindrical extension 2', the upper edge portion 2'' of which bears against the abutment plate 11. The abutment plate 11 is removably secured by means of fixing screws 12. In the angle formed between the semi-cylindrical extension 2' and the cylindrical part of the mounting member 2, the first former-member or shaping tool 14 is rotatably mounted in a transverse recess 13 in the mounting member, which recess is open at the front. The member 14 has a central bore 15 and a sector-shaped cut-away portion 16 extending over its entire length. The cut-away portion 16 forms a flat clamping face 17 at the top of the member 14, and a like-wise flat bending face 18 with a rolling edge 19, at the bottom of the member 14. The horizontal abutment plate secured to the housing terminates adjacent the clamping face 17. (note that FIG. 1 shows the piston in an actuated condition)

Formed in the extension 2' of the mounting member 2 are longitudinal bores 20 which serve to accommodate return compression springs 21 which are backed by the end-cap 10 of the housing and press back the mounting member 2 when the working pressure ceases to be applied. Towards the middle, further bores 22 are formed, these extending through a fitting 23 welded on to the end-cap 10; fitted in these bores are further return compression springs 24 which act on longitudinally displaceable thrust bolts 25. By way of lugs 28', these thrust bolts 25 are operationally connected to stops 14' formed by cutting away portions of the member 14.

After the member 14 has completed its work and for the purpose of limiting its reverse rotation, initiated by the spring-biased thrust bolts 25, grooves 26 are formed in the top of the member 14, and associated with these grooves are limiting stops or screws 27 in the mounting member 2, which stops or screws engage in said grooves.

Fitted on the top of the housing 1 is a carrier plate 28 for a protective sheet-metal part 29 extending into the gap between the end-face 11' of the abutment plate 11 and the clamping face 17. This protective part is movably mounted and performs the function of protecting the surface of the edge of the sheet-metal part that is to be turned over against damage by the clamping face 17. The mode of operation of the illustrated hand-tool is as follows:

If, for example, an edge 31 of a metal sheet 30 (FIGS. 4 and 5) is to be turned over, the hand-tool is held in both hands by its grip 7 and its housing 1 and is pushed upwards on to the metal sheet 30 so that the edge of the sheet is located between the end-face 11' of the abutment plate 11 and the clamping face 17, and in front of the bending face 18. When the button 8 is pressed, the member 14 is applied to the metal sheet 30 so that the sheet is first clamped by the clamping face 17 against the end-face 11' of the abutment plate 11, and thereafter the member 14 rotates clockwise (viewed as illustrated) so that the edge of the metal sheet is bent round at right-angles by the bending face 18. When the bending over of the edge 31 of the metal sheet is completed and the working pressure applied by the hydraulic piston-and-cylinder unit ceases, the springs 21 become effective and push the bearing 2, together with the member 14, back into its initial position. The rotation of the member 14 in the reverse direction is also accomplished by the springs 24.

The perspective illustration in FIG. 6 shows that the member 14 has an inclined inlet portion 32, that is that the level of the bending face 18 drops to the level 18', so that the rolling edge 19 is set back to the inlet level 19' (see dash-dot contour in FIG. 5), with the result that the edge 31 of the metal sheet is first gently angled, and thereafter the right-angle bend is completely formed by the following straight portion 32'.

FIGS. 5 and 6 also show that the inlet zone of the member 14 may extend to a level 18'' (dotted lines), and it has been found advantageous to use an angle $\alpha$ of approximately 20° for the slope of the surface 18'' transversely to the working direction.

Using the tool with different former-members, it is possible instead of forming right-angled edges on metal sheets, as shown in FIGS. 4 to 6, to form edges of almost any required profile. FIGS. 7 to 10 illustrate such possibilities. To obtain these shapes, the abutment plate 11 and the member 14 are chosen with appropriate complementary profiles.

What we claim is:

1. A tool for bending a sheet metal workpiece, the tool comprising:

a first former-member mounted for rotational movement about a first axis, a second former-member arranged adjacent the first former-member to allow a sheet metal workpiece to be inserted between the first and second former-members for bending, mounting means mounting the first and second former-members to allow one at least of the former-members to move towards and away from the other along a second axis, the first axis being transverse to the second axis, force-applying means to force the said one at least of the former-members towards the other along the second axis, and a respective bending profile provided on each of the former-members, the profiles being such that when, in use, the two former-members are forced together with a sheet metal workpiece intervening the first former-member is caused to rotate about the first axis and in so doing bends a part of the workpiece to a predetermined shape defined by the profiles, each profile includes a clamping portion and a bent-shape defining portion, the clamping portion of the first former-member comprising two faces at an angle corresponding to the angle of rotation of the first former-member in use, and the clamping portion of the second former-member comprising a face arranged to be parallel to one of the faces on the first former-member when the first former-member is in an initial position before it rotates to bend a workpiece and to be parallel to the other of the faces on the first former-member when the first former-member is in a final position after bending a workpiece.

2. A tool as claimed in claim 1, wherein the mounting means comprises a housing and a mounting member for the first former-member displaceably mounted in the housing.

3. A tool as claimed in claim 1, wherein one or more compression springs are provided to bias the first former-member away from the second former-member and exert a torque on it opposite to its direction of rotation in bending a workpiece.

4. A tool as claimed in claim 3, wherein the first former-member has one or more grooves co-operating with a or a respective projection projecting into the associated groove to define the initial position of the first former-member before it rotates to bend a workpiece.

5. A tool as claimed in claim 1, wherein the second former-member is detachably mounted to enable it to be exchanged for another such member.

6. A tool for bending a sheet metal workpiece according to claim 1, and the clamp face of the second former-member being toothed.

7. A tool as claimed in claim 1 wherein the two faces of the clamping portion of the first former-member adjoin each other at a location opposite the clamping portion of the second former-member.

8. A tool as claimed in claim 1 wherein the bent-shape defining portions have substantially flat faces angularly related to said faces of the clamping portions.

9. A tool as claimed in claim 1 wherein the bent-shape defining portions have smoothly rounded faces in relation to said faces of the clamping portions.

10. A tool as claimed in claim 1 wherein the bent-shape defining portions have smoothly rounded and flat faces angularly related to each other.

11. A tool as claimed in claim 1 wherein the bent-shape defining portions have smoothly rounded faces angularly related to said faces of the clamping portions.

* * * * *